US011357267B2

(12) United States Patent
Klein et al.

(10) Patent No.: US 11,357,267 B2
(45) Date of Patent: Jun. 14, 2022

(54) METHOD FOR PRODUCING AN ARTICLE OF CLOTHING AND AN ARTICLE OF CLOTHING

(71) Applicant: FALKE KGaA, Schmallenberg (DE)

(72) Inventors: Michael Klein, Bayreuth (DE); Jürgen Mrozek, Gersdorf (DE)

(73) Assignee: FALKE KGaA, Schmallenberg (DE)

( * ) Notice: Subject to any disclaimer, the term of this patent is extended or adjusted under 35 U.S.C. 154(b) by 462 days.

(21) Appl. No.: 15/258,729

(22) Filed: Sep. 7, 2016

(65) Prior Publication Data

US 2016/0374410 A1 Dec. 29, 2016

Related U.S. Application Data

(63) Continuation of application No. PCT/EP2015/054756, filed on Mar. 6, 2015.

(30) Foreign Application Priority Data

Mar. 12, 2014 (DE) ..... 10 2014 103 309.4

(51) Int. Cl.
*A41B 11/00* (2006.01)
*A41D 31/18* (2019.01)

(52) U.S. Cl.
CPC ..... *A41B 11/008* (2013.01); *A41D 31/18* (2019.02); *A41B 2400/82* (2013.01)

(58) Field of Classification Search
CPC ..... A41B 11/008; A41B 2400/80; A41B 2400/82
See application file for complete search history.

(56) References Cited

U.S. PATENT DOCUMENTS 2,795,822 A * 6/1957 Long ..... A43D 3/023 264/244
4,651,354 A * 3/1987 Petrey ..... A41B 11/004 2/239

(Continued)

FOREIGN PATENT DOCUMENTS

DE 199 40 018 3/2001
DE 10 2006 0333 393 1/2008

(Continued)

OTHER PUBLICATIONS

European Patent Office, Extended European Search Report, issued in connection with European Application No. 18 157 229.8, dated Jun. 25, 2018, with English translation, 12 pages.

(Continued)

*Primary Examiner* — Megan E Lynch
(74) *Attorney, Agent, or Firm* — Hanley, Flight & Zimmerman, LLC

(57) ABSTRACT

In order to provide a method for producing an article of clothing, which comprises a textile main body and functional elements arranged on the textile main body, which offers a large degree of design freedom with regard to the geometry of the functional elements and ensures good adhesion of the functional elements to the textile main body, it is proposed that the method comprises the following:

producing the textile main body;

providing a shaped part having at least one functional-element recess for accommodating a functional-element starting material;

introducing the functional-element starting material into the at least one functional-element recess;

bringing the shaped part, which is provided with the functional-element starting material, and the textile main body into contact;

(Continued)

producing at least one functional element connected to the textile main body in a substance-to-substance bonded manner from the functional-element starting material.

26 Claims, 13 Drawing Sheets

(56) References Cited

U.S. PATENT DOCUMENTS

| | | | | |
|---|---|---|---|---|
| 4,728,538 | A * | 3/1988 | Kaspar | D06M 17/06 118/202 |
| 4,896,441 | A * | 1/1990 | Galasso | A43B 7/1415 36/140 |
| 6,255,235 | B1 * | 7/2001 | Hiraoka | A41D 19/01547 442/101 |
| 6,673,421 | B1 * | 1/2004 | Andrews | A41B 11/04 2/239 |
| 2006/0026740 | A1 * | 2/2006 | Vargas | A41B 11/02 2/239 |
| 2007/0028365 | A1 * | 2/2007 | Williams | A41B 11/00 2/239 |
| 2008/0156044 | A1 * | 7/2008 | Patterson | A41B 11/004 66/178 R |
| 2009/0288566 | A1 * | 11/2009 | Maihoefer | B41C 1/14 101/126 |
| 2010/0256717 | A1 * | 10/2010 | Brown | A61F 5/026 607/115 |
| 2011/0055995 | A1 * | 3/2011 | Dassler | A41D 19/01523 2/161.1 |
| 2011/0302686 | A1 * | 12/2011 | Chapuis | A41D 13/0015 2/69 |
| 2012/0058316 | A1 * | 3/2012 | Cherneski | A41B 17/00 428/197 |
| 2013/0145521 | A1 * | 6/2013 | Spicuzza | A41B 11/007 2/239 |
| 2014/0068965 | A1 * | 3/2014 | Vattes | A43B 13/40 36/10 |
| 2014/0223630 | A1 * | 8/2014 | Johnson | A41D 19/01547 2/69 |
| 2014/0230124 | A1 | 8/2014 | Wilms-Otto | |
| 2015/0173428 | A1 | 6/2015 | Langer et al. | |
| 2015/0173430 | A1 * | 6/2015 | Langer | A41D 13/0015 2/79 |

FOREIGN PATENT DOCUMENTS

| | | |
|---|---|---|
| DE | 202009004214 | 9/2010 |
| DE | 10 2011 002 192 | 10/2012 |
| DE | 102012216180 | 3/2014 |
| WO | 2012143398 | 10/2012 |
| WO | 2013053370 | 4/2013 |
| WO | 2014041075 | 3/2014 |
| WO | 2014041077 | 3/2014 |

OTHER PUBLICATIONS

International Searching Authority, English translation of the International Preliminary Examination Report, issued in connection with International Application No. PCT/EP2015/054756, dated Sep. 22, 2016, 8 pages.

German Patent Office, "Office Action", issued in connection with German Patent Application No. 10 2014 103 309.4, dated Jan. 23, 2015, 8 pages.

International Searching Authority, "International Search Report and Written Opinion", issued in connection with International Application No. PCT/EP2015/054756, dated Jun. 1, 2015, 6 pages.

International Searching Authority, "International Preliminary Examination Report", issued in connection with International Application No. PCT/EP2015/054756, dated Jun. 1, 2015, 7 pages.

* cited by examiner

METHOD FOR PRODUCING AN ARTICLE OF CLOTHING AND AN ARTICLE OF CLOTHING

RELATED APPLICATION

This application is a continuation application of PCT/EP2015/054756 filed on Mar. 6, 2015, the entire specification of which is incorporated herein by reference.

FIELD OF DISCLOSURE

The present invention relates to a method for producing an article of clothing which comprises a textile main body and functional elements arranged on the textile main body.

BACKGROUND

It is known to produce knops of a silicone material on the bottom of the sole region of children's socks by means of a silk-screen printing process.

When using a silk-screen printing process however, the geometries attainable for the functional elements are very much limited. Furthermore, the adherence of the functional elements to the textile main body produced by silk-screen printing on a textile main body is barely sufficient.

SUMMARY OF THE INVENTION

The object of the present invention is to provide a method for producing an article of clothing that comprises a textile main body and functional elements arranged on the textile main body which offers a large degree of freedom in regard to the geometry of the functional elements and ensures good adherence of the functional elements to the textile main body.

In accordance with the invention, this object is achieved by a method for producing an article of clothing that comprises a textile main body and functional elements arranged on the textile main body which comprises the following:

- producing the textile main body;
- providing a shaped part having at least one recess for a functional element for accommodating a functional-element starting material;
- introducing the functional-element starting material into the at least one recess for a functional element;
- bringing the shaped part which is provided with the functional-element starting material and the textile main body into contact;
- producing at least one functional element that is connected to the textile main body by a substance-to-substance bond from the functional-element starting material.

Thus, the concept underlying the present invention is to define the geometry of at least one of the functional elements that is to be produced by the design of a recess for the functional element in a shaped part, wherein the recess for the functional element is at least partially complementary to the functional element that is produced with the help of the recess for the functional element.

In particular, the substance-to-substance bond between the functional element and the textile main body can be produced in that the functional-element starting material penetrates into the textile main body due to the process of bringing the shaped part and the textile main body into contact and subsequently, preferably under the effect of a raised pressure and/or a raised temperature, it sets.

The functional elements preferably form a stimulus inducing structure of the article of clothing which, in the worn state, causes a sensory stimulating effect on certain parts of the wearer's body such as a proprioceptive stimulation of the musculature for example.

In a preferred embodiment of the method in accordance with the invention, the textile main body is produced by knitting or weaving.

In particular, provision may be made for a region of the textile main body upon which at least one functional element is arranged to be in the form of a tuck-stitch knitted fabric.

Furthermore, provision is preferably made for at least one functional element to be produced in a compression region of the article of clothing in which, in the worn state, the article of clothing exerts a compressive effect on the body of the wearer of the article of clothing.

In particular, provision may be made for at least one functional element to be produced in a compression region of the textile main body of the article of clothing in which, in the worn state of the article of clothing, the textile main body exerts a compressive effect on the body of the wearer of the article of clothing.

Such a compression region can be formed, in particular, in that an elastic thread or a plurality of elastic threads are worked into the textile main body.

Preferably, at least two different types of functional elements are arranged in the same compression region of the article of clothing, said functional elements differing from one another in regard to the shape thereof and/or the height and/or the diameter thereof and/or the degree of hardness thereof and in particular, in regard to the Shore A-hardness thereof.

Furthermore, provision is preferably made for at least one functional element to comprise a synthetic material, preferably, to be formed substantially entirely of a synthetic material.

In particular, such a synthetic material can be an elastomeric material such as a silicone material for example and in particular, a two-component material.

It is especially expedient if at least one functional element has a Shore A-hardness of at least approximately 40.

Furthermore, it is expedient if at least one functional element has a Shore A-hardness of at most approximately 100.

Hereby, the Shore A-hardness can be determined in accordance with DIN 53505 or DIN EN ISO 868.

In a preferred embodiment of the invention, provision is made for at least two functional elements to be produced which have different degrees of Shore A-hardness.

In particular, at least two functional elements can be produced from different functional-element starting materials which have different degrees of Shore A-hardness after setting.

Preferably, the difference in the degrees of Shore A-hardness of the two functional elements amounts to at least approximately 10, especially preferred, at least approximately 20 and in particular, at least approximately 30.

Furthermore, provision is preferably made for at least two functional elements to be produced which are of different heights.

Herein, the height of a functional element is to be understood as being the extent thereof perpendicularly to a major face of the textile main body and in particular, perpendicular to an inner surface of the textile main body facing the wearer's body in the worn state of the article of leg clothing.

Preferably, the difference between the heights of the two functional elements amounts to at least approximately 0.5 mm, especially preferred, to at least approximately 1 mm and in particular, to at least approximately 2 mm such as at least approximately 3 mm for example.

In a preferred embodiment of the method in accordance with the invention, provision is made for an auxiliary filling element to be arranged on the shaped part whilst the functional-element starting material is being introduced into the at least one recess for a functional element, wherein the auxiliary filling element is removed from the shaped part before bringing the shaped part and the textile main body into contact.

In this way, the effect is achieved that, after the removal of the auxiliary filling element, the functional-element starting material that has been filled into the recess for a functional element protrudes from the recess for the functional element by an excessive amount, wherein the effect of the excess of functional-element starting material is that an adequate amount of functional-element starting material will penetrate into the textile main body so as to establish a firm, permanent substance-to-substance bond with the textile main body.

Preferably, provision is made for the auxiliary filling element to comprise at least one filling opening which is associated with one of the recesses for functional elements in the shaped part that is to be filled with functional-element starting material.

Preferably, the filling opening is also filled with the functional-element starting material at the same time as the process of introducing the functional-element starting material into the recess for the functional element.

The excess amount of functional-element starting material remaining after the removal of the auxiliary filling element from the shaped part substantially corresponds to the thickness of the auxiliary filling element.

The auxiliary filling element is preferably in the form of a planar element having a thickness of at least approximately 0.04 mm and in particular, of at least approximately 0.08 mm.

Furthermore, provision is preferably made for the auxiliary filling element to be in the form of a planar element having a thickness of at most approximately 0.7 mm and in particular, of at most approximately 0.35 mm.

In particular, the auxiliary filling element can be in the form of a foil or a screen.

Furthermore, the present invention relates to an article of clothing which comprises a textile main body and functional elements arranged on the textile main body.

The further object of the present invention is to produce such an article of clothing wherein the functional elements exert an especially effective stimulus-inducing effect and in particular, a proprioceptive stimulating effect on the wearer of the article of clothing.

In accordance with the invention, this object is achieved in the case of an article of clothing in accordance with the first part of claim 13 in that the article of clothing comprises at least two functional elements which have mutually differing heights and/or a mutually differing degree of Shore A-hardness.

Preferably, the functional elements of mutually differing heights and/or mutually differing degrees of Shore A-hardness are arranged in a compression region of the article of clothing whereat, in the worn state, the article of clothing exerts a compressive effect on the body of the wearer of the article of clothing.

Due to the fact that the at least two different functional elements have mutually differing heights and/or mutually differing degrees of Shore A hardness, these different functional elements can exert differing amounts of pressure on the tissue of the wearer which rests against the functional elements in the worn state of the article of clothing.

Hereby, it is desirable that this pressure be experienced not only by receptors in the wearer's skin, but also by receptors in the more deeply lying fascicular layer, the so-called superficial fascia, which is located in the subcutaneous tissue, so that these lower-lying receptors can also be stimulated by the functional elements.

Since the superficial fascia can be located at different depths in the tissue depending upon the subcutaneous fatty tissue of the wearer, the functional elements are preferably formed in such a way that they differ from each other as regards to height, diameter and/or hardness.

Due to the different designs, the functional elements produce a higher or lower pressure in dependence on how far the superficial fascia is located below the skin.

It has proven to be especially expedient for at least one functional element to have a substantially conical section and in particular, to comprise a conical section or a section in the form of a frustum of a cone.

Furthermore, it is also possible to form the functional element such that it is substantially conical in its entirety.

In principle however, the functional element could also be entirely or partly in the form of a pyramid, a hemisphere, a cube or a cylinder.

The differing geometries and degrees of hardness of the various functional elements of the article of clothing and the different types of pressure that are obtainable thereby offer the further advantage that the stimulus inducing structure, which is formed by the functional elements and/or the compression region of the article of clothing in which the functional elements are arranged, presses on parts of the body of the wearer of the article of clothing with a different pressure in dependence upon whether the wearer's body has a convex curvature at the bearing surface of the stimulus inducing structure or the compression region, such as the calf musculature, the so-called muscle belly for example, or a concave curvature such as that in the region of the ankle bones, the so-called malleoli for example.

In a region of the article of clothing which rests against a convexly curved region of the wearer's body, a functional element of lesser height and/or a functional element of lower hardness will suffice in order to exert the same pressure on the tissue of the wearer as that applied using a greater height and/or a higher hardness of the functional element in a region of the article of clothing which rests against a concavely curved region of the wearer's body.

Moreover, functional elements of differing heights and/or different degrees of hardness and the different types of pressure obtained thereby offer the further advantage that the stimulated receptors of the wearer of the article of clothing are restrained from switching into a habituation mode when the article of clothing is worn over a longer stretch of time. A habituation effect can occur due to constant pressure of the functional elements on the body of the wearer thereby leading to reducing stimulation of the receptors in the wearer's body which can result in a declining stimulus-inducing effect of the article of clothing.

It may therefore be useful to also implement a variation in the geometry and in particular the height and the hardness of the functional elements within a region of the article of clothing resting against a concave part of the body and/or within a region of the article of clothing resting against a convex part of the body.

If the article of clothing comprises a first region which rests against a concavely curved part of the wearer's body in the worn state of the article of clothing and a second region which rests against a convexly curved part of the wearer's body in the worn state of the article of clothing, wherein a first functional element is arranged in the first region of the article of clothing and a second functional element is arranged in the second region of the article of clothing, then the height of the first functional element is preferably greater than the height of the second functional element and/or the Shore A-hardness of the first functional element is larger than the Shore A-hardness of the second functional element.

Hereby, the difference in heights of the functional elements preferably amounts to at least approximately 0.5 mm, especially preferred at least approximately 1 mm and in particular, at least approximately 2 mm such as at least approximately 3 mm for example.

The difference in the degrees of Shore hardness hereby preferably amounts to at least approximately 10, especially preferred at least approximately 20 and in particular, at least approximately 30.

The concavely curved part of the body may be an ankle bone region for example.

The convexly curved part of the body may be a calf region for example.

In a preferred embodiment of the invention, provision is made for at least one functional element to be in the form of a knop.

For example, a functional element in the form of a knop may be entirely or partially in the form of a cone, a truncated cone, a pyramid, a hemisphere, a cube or a cylinder.

Furthermore, provision may be made for the greatest extent of at least one functional element along the textile main body to be at most approximately 12 mm and in particular, at most approximately 6 mm.

In a preferred embodiment of the invention, provision is made for at least one functional element to be arranged on an inner surface of the textile main body which faces the wearer's body in the worn state of the article of clothing.

The method in accordance with the invention for producing an article of clothing can be carried out manually, by needlework, semi-mechanically or by machine.

The most cost effective method can be selected in dependence on the quantity desired.

In particular, the article of clothing in accordance with the invention may be in the form of an article of leg clothing.

In particular hereby, the expression article of leg clothing covers stockings, socks and any other kind of hosiery, including tights, as well as trousers such as shorts and three-quarter length trousers for example, leggings, leg stockings (both short and long), foot and knee bandages.

Furthermore, provision may be made for the article of clothing in accordance with the invention to be in the form of an article of upper body clothing.

Hereby, the expression article of upper body clothing covers any article of clothing which is worn close to the body on any part of the wearer's upper body including the arms and in particular, shirts, body suits, vests, oversleeves, elbow and hand bandages.

In the following detailed description of exemplary embodiments of the invention, the invention is described exemplarily for the case of an article of leg clothing in the form of a stocking.

Likewise however, the features disclosed in connection with this exemplary embodiment can be realised in an article of clothing which is in the form of another article of leg clothing or which is in the form of an article of upper body clothing.

Further features and advantages of the invention form the subject matter of the following description and the graphic illustration of exemplary embodiments.

BRIEF DESCRIPTION OF THE DRAWINGS

Similar or functionally equivalent elements are denoted by the same reference symbols in all of the Figures.

DETAILED DESCRIPTION OF THE INVENTION

Figure 1:
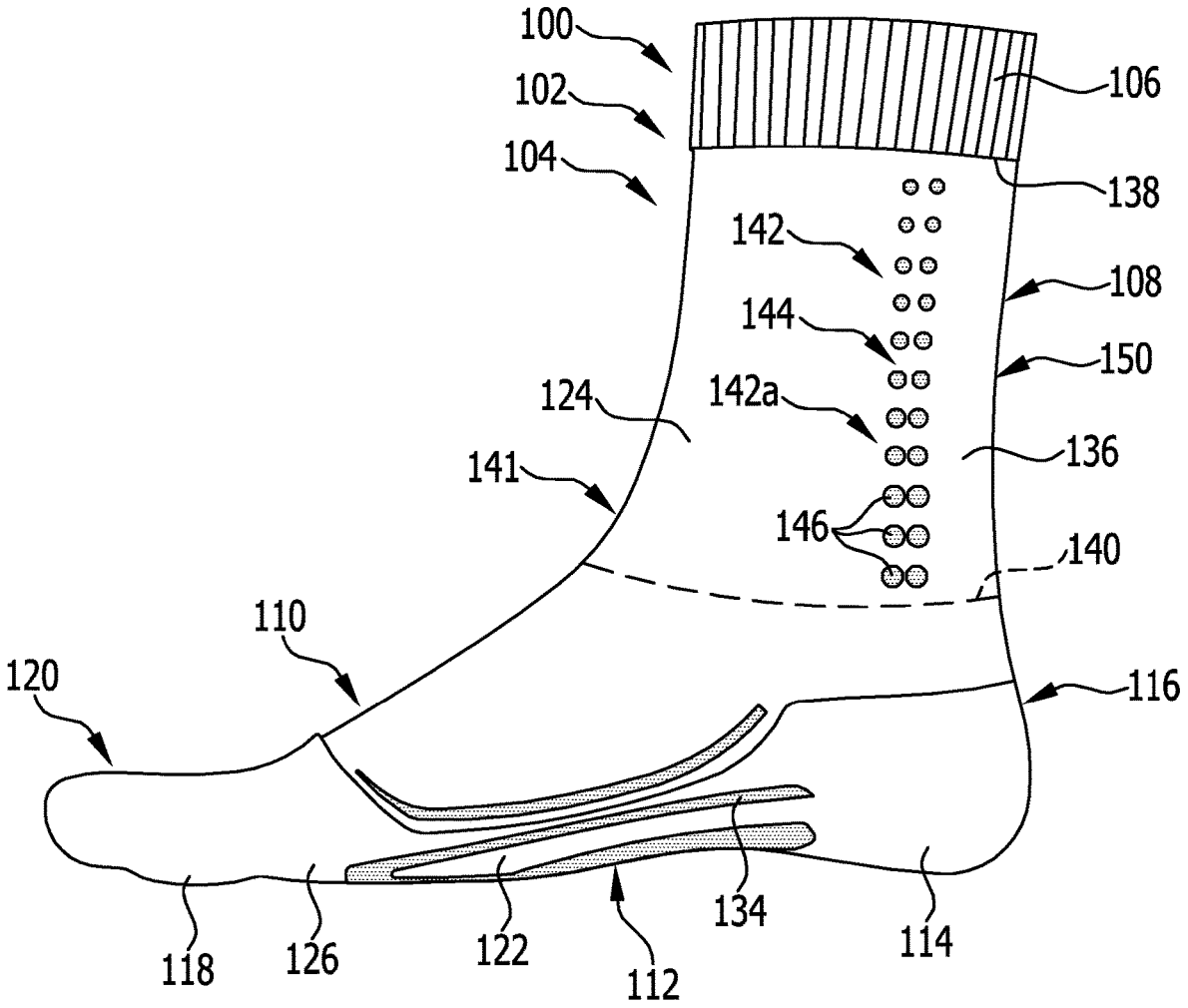
FIG. 1 shows a side view of an article of clothing such as a stocking which comprises a textile main body and functional elements arranged on the main body, wherein the article of clothing is turned in such a way that the inner surface of the article of clothing facing the body of the wearer in the worn state of the article of clothing faces outwardly in this turned state so that the functional elements arranged on the inner surface of the textile main body are visible to the viewer.
Figure 2:
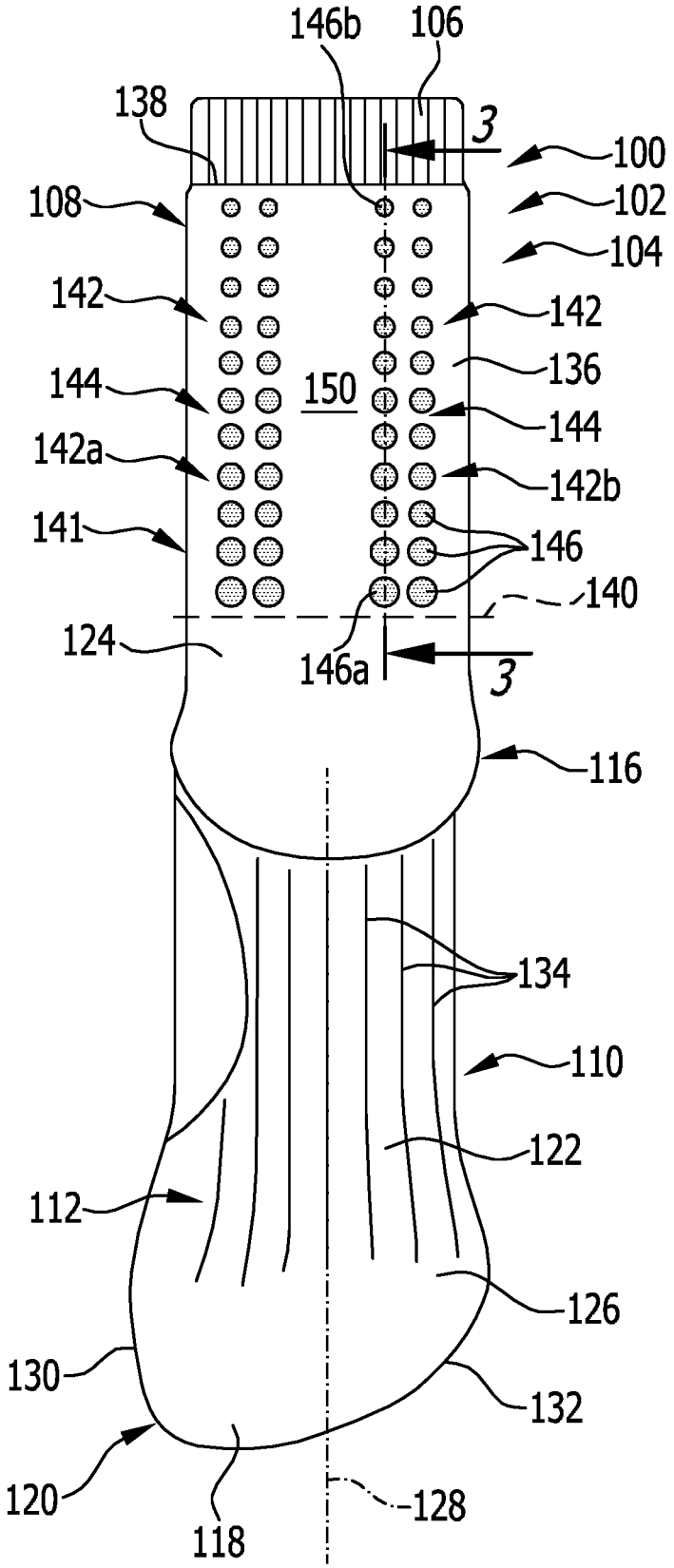
FIG. 2 a rear view of the article of clothing depicted in FIG. 1, wherein a foot part of the article of clothing is folded back relative to a shank region of the article of clothing which carries the functional elements.

An article of clothing which is designated as a whole by 100 and is illustrated in FIGS. 1 and 2 is in the form of an article of leg clothing 102 and in particular, in the form of a stocking 104 for example.

The stocking 104 comprises a cuff region 106 at the upper end of the stocking 104, a shank region 108 downwardly adjoining the cuff region 106 and a foot region 110 which encloses the foot of the wearer in the worn state and which extends downwardly and forwardly from the shank region 108.

The lower half of the foot region 110 of the stocking 104 forms a sole region 112 which comprises a lower half 114 of a heel region 116, a lower half 118 of a toe region 120 and an intermediate region 122 which is located between the heel region 116 and the toe region 120.

The shank region 108 and the foot region 110 of the stocking 104 are preferably continuous and are formed from a ground fabric 124 which comprises one or more ground threads. The ground thread or the ground threads can be formed of any material such as a natural fibre or a chemical fibre for example.

For the purposes of protecting the wearer's leg from compressive or shock loads and/or for the purposes of protecting from heat loss, the stocking 104 can be provided with one or more pads.

In particular, the foot region 110 of the stocking 104 can be provided with a foot pad 126 which extends from the toe region 120 via the intermediate region 122 of the sole region 112 up to the heel region 116.

As can best be seen from FIG. 2, this foot pad 126 of the stocking 104 is preferably asymmetrical with respect to a longitudinal centre plane 128 of the foot region 110.

In particular, a portion of the foot region 110 of the foot pad 126 which is arranged in the region of the inner foot arch of the wearer of the stocking 104 in the worn state of the stocking 104 can be removed from the foot pad 126 on the inner side of the stocking 104, i.e. on the side which faces the wearer's other leg in the worn state of the stocking 104. Since the wearer of the stocking 104 does not tread on this region of the inner foot arch when walking, the outer contour of the foot pad 126 at the bottom of the foot region 110 thus substantially corresponds to the outer contour of the footfall area of the wearer of the stocking 104.

The toe region 120 provided with the foot pad 126 can likewise be asymmetrical with respect to the longitudinal centre plane 128 of the foot region 110 in order to provide better matching of the stocking 104 to the outline of the toes of the wearer of the stocking 104.

In particular, provision may be made for an inner edge section 130 of the toe region 120 that is arranged to the side of the wearer's big toe to be inclined to the longitudinal centre plane 128 of the foot region 110 at a smaller angle than an outer edge section 132 of the toe region 120 that is arranged to the side of the small toe of the wearer.

A method of producing such an asymmetrical toe region 120 is described in EP 1 049 828 BI.

Furthermore, a plurality of channels 134 extending substantially parallel to the longitudinal centre plane 128 of the foot region 110 can be provided within the outer contour of the foot pad 126, the stocking 104 having a lesser degree of reinforcement in the region of said channels than in the regions of the foot pad 126 surrounding the channels 134.

In particular, provision may be made for the stocking 104 to comprise only the ground fabric 124 but no additional reinforcement threads within the region of the channels 134.

The foot pad 126 may incorporate one or more reinforcement threads which may be formed of any material.

Preferably, provision is made for the reinforcement thread or threads of the foot pad 126 to form plush loops which are preferably located on the "reverse side of the goods", i.e. on the inner surface of the stocking 104 facing the leg of the wearer when the stocking 104 is being worn.

Furthermore, the stocking 104 comprises one or more compression regions 136 in which the stocking 104 exerts a compressive effect on the leg of the wearer in the worn state.

In particular, this compressive effect can be obtained by working one or more elastic threads into the ground fabric 124 of the stocking 104.

In particular, the elastic thread or the elastic threads may comprise elastane.

In particular, the stocking 104 can comprise a compression region 136 which extends downwardly from the top edge 138 of the shank region 108 to a lower edge 140 of the compression region 142.

Hereby, the lower edge 140 of the compression region 136 can be located above an ankle region of the stocking 104 which rests on the wearer's ankle in the worn state of the stocking 104. However, the compression region 136 could also extend into the heel region 116.

The compressive force within the compression region 136 preferably amounts to at least approximately 10 mm Hg and/or to at most approximately 32 mm Hg, and in particular to at most approximately 25 mm Hg.

The compressive force may be constant or exhibit a gradient in the compression region 136.

Thus in particular, the compression region 136 can exhibit a compression gradient wherein the compressive force decreases from bottom to top.

In particular, provision may be made for the compressive force at the upper edge 138 of the compression region 136 to amount to from approximately 60% to approximately 80% of the compressive force at the lower edge 140 of the compression region 136.

The cuff region 106, the shank region 108 and the foot region 110 which are formed from the ground fabric 124, the foot pad 126 and the elastic threads of the compression region 136 together form a textile main body 141 of the article of clothing 100.

Moreover, the stocking 104 comprises one or more stimulus inducing zones 142 which are each provided with a stimulus inducing structure 144.

Each stimulus inducing structure 144 comprises functional elements 146 which exert a sensory stimulating effect on the wearer in the worn state of the stocking 104.

This stimulation leads to positive bodily/physiological reactions such as increased muscle activity for example and can improve the synchronization of the wearer.

The functional elements 146 are in the form of raised portions which are arranged on the inner surface 148 of the textile main body 141 of the stocking 104 facing the wearer's body in the worn state of the article of clothing 100 and they are effective directly on the wearer's skin.

In particular, thermoplastic or thermosetting polymers which may possibly contain additives are suitable as materials for the functional elements 146.

Silicone and PVC based plastisol have proved to be especially suitable.

For the purposes of achieving effective stimulation of certain parts of the body and in particular the musculature of the wearer, it is expedient if the stimulus is locally limited and in particular is effected substantially punctiformly, preferably by means of substantially knop-like functional elements 146.

Consequently, it is expedient if the greatest extent L of the functional elements 146 along the textile main body 141 is at most approximately 12 mm and preferably at most approximately 6 mm.

Furthermore, it is expedient, if the greatest extent L of the respective functional elements 146 along the textile main body 141 amounts to at least approximately 1 mm.

The height H of the functional elements 146, i.e. the extent thereof perpendicularly to the inner surface 148 of the textile main body 141 by which the functional elements 146 protrude onto the skin of the wearer, preferably amounts to at least approximately 0.5 mm and in particular to at least approximately 1 mm.

Furthermore, it is expedient if the height of the functional elements 146 amounts to at most approximately 12 mm and in particular to at most approximately 6 mm.

Figure 3:
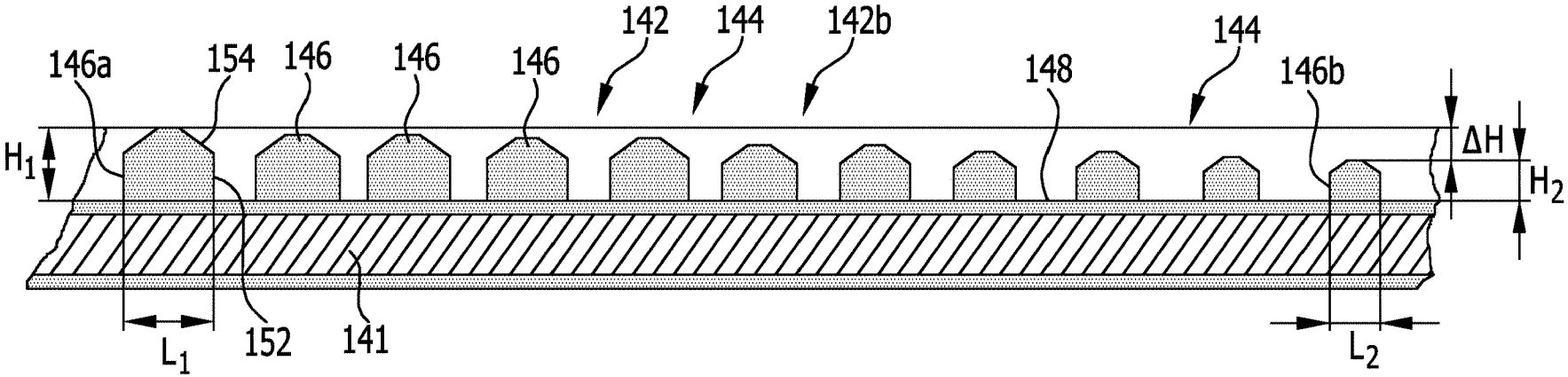
FIG. 3 a schematic longitudinal section through the textile main body and a row of functional elements of the article of clothing along the line 3-3 in FIG. 2.

As can best be seen from FIG. 3, provision is preferably made for the height H of different functional elements 146 of the article of clothing 100 and in particular the stimulus inducing structure 144 thereof and/or the compression region 136 thereof to vary.

A stimulus inducing structure 144 and in particular a first functional element 146*a* may have a height $H_1$ and a second functional element 146*b* a height of $H_2$, wherein the height $H_1$ of the first functional element 146*a* is greater than the height $H_2$ of the second functional element 146*b* by the amount $\Delta H$.

Hereby, the height difference $\Delta H$ preferably amounts to at least approximately 0.5 mm, especially preferred at least approximately 1 mm and in particular, at least approximately 2 mm such as at least approximately 3 mm for example.

The remaining functional elements 146 of the stimulus inducing structure 144 can be of heights H which lie between the greatest height $H_1$ and the smallest height $H_2$.

In particular, provision may be made for the height H of the functional elements 146 of a stimulus inducing structure 144 to decrease substantially constantly from one end of the stimulus inducing structure 144 up to the other end of the stimulus inducing structure 144.

If the article of clothing 100 comprises a first region which rests in the worn state of the article of clothing 100 against a concavely curved part of the wearer's body such as the ankle bone, the so-called malleolus, for example, and a second region which rests in the worn state of the article of clothing against a convexly curved part of the wearer's body such as the calf musculature, the so-called muscle belly, for example, then the height $H_1$ of a functional element 146 in the first region of the article of clothing 100 is preferably greater than the height $H_2$ of a functional element 146 in the second region of the article of clothing 100.

That is to say that a lower height for the functional element 146 in the second region of the article of clothing is sufficient to exert the same pressure on the tissue of the wearer as is exerted by a functional element of greater height in the first region.

In the embodiment of an article of clothing 100 in the form of a stocking 104 that is illustrated in FIGS. 1 and 2, there are provided two stimulus inducing zones 142*a* and 142*b* wherein the stimulus inducing structures 144 thereof are respectively arranged on the left and the right of the wearer's Achilles tendon in the worn state of the stocking 104.

The stimulus inducing zones 142*a* and 142*b* are thus arranged on mutually opposite sides of an Achilles tendon region 150 of the stocking 104.

Since the lower end regions of the stimulus inducing zones 142*a*, 142*b* rest on the wearer's ankle bone in the worn state of the stocking 104, whilst the upper end regions of the stimulus inducing zones 142*a*, 142*b* rest against the convexly curved calf region of the wearer in the worn state of the stocking 104, the height H of the functional elements 146 preferably reduces from bottom to top in the stimulus inducing zones 142*a*, 142*b*.

Preferably, the greatest extent L of the functional elements 146 along the inner surface 148 of the textile main body 141 also decreases from bottom to top in the stimulus inducing zones 142*a*, 142*b*.

As can be see from FIG. 3, the greatest extent $L_1$ of the first functional element 146*a* along the inner surface 148 of the textile main body 141 is preferably greater than the greatest extent $L_2$ of the second functional element 146*b* along the inner surface 148 of the textile main body 141.

The functional elements 146 are preferably formed from a material having a Shore A-hardness of at least approximately 30 and in particular, of at least approximately 40.

Furthermore, it is expedient if the Shore A-hardness of the material of the functional elements 146 amounts to at most approximately 100 and preferably to at most approximately 90.

It is especially expedient if the Shore A-hardness of the material of the functional elements amounts to approximately 60.

The Shore A-hardness can be determined in accordance with DIN 53505 or DIN EN ISO 868.

Preferably, provision is made for different functional elements 146 of the article of clothing 100 and in particular, the stimulus inducing structure 144 and/or the compression region 136 thereof to have degrees of Shore A-hardness that differ from one another.

Thus for example, provision is made for the Shore A-hardness of the material of the first functional element 146 to be greater by a value $\Delta S$ than the Shore A-hardness of the material of the second functional element 146*b* (see FIG. 3), wherein $\Delta S$ preferably amounts to at least approximately 10, especially preferred to at least approximately 20 and in particular, to at least approximately 30.

In the first region of the article of clothing 100 which rests against a concavely curved part of the body of the wearer in the worn state of the article of clothing 100, the Shore A-hardness of the material of the functional elements 146 is preferably greater than it is in the second region of the article of clothing which rests against a convexly curved part of the body of the wearer in the worn state of the article of clothing.

The cross sections (taken perpendicularly with respect to the height direction) of the functional elements 146 are illustrated as being substantially circular in FIGS. 1 to 3.

In principle however, the functional elements 146 could have any other form of cross section such as a triangular cross section, a square cross section, a rectangular cross section, a polygonal cross section or an angular cross section for example.

The functional elements 146 may be in the form of a cone, a pyramid, a hemisphere, a cube or a cylinder for example.

In the case of the preferred embodiment illustrated in FIG. 3, the functional element 146 has a substantially cylindrical lower section 152 and an upper section 154 which is substantially conical and in particular substantially in the form of a frustum of a cone.

In order for the functional elements 146 to be pressed against the wearer's body with sufficient pressure, it is expedient for the textile main body 141 to be knitted in a knitting pattern which produces a greater level of compression in the region within which the functional elements 146 are arranged.

In particular, provision may be made for the knitted region of the textile main body 141 in which the functional elements 146 are arranged to be in the form of a tuck-stitch knitted fabric.

Such a tuck-stitch type knitted fabric may comprise a plurality of tuck stitches extending over a plurality of rows of stitches.

The previously described article of clothing 100 comprising a textile main body 141 with functional elements 146 connected thereto by a substance-to-substance bond can, for example, be produced as follows:

The textile main body 141 is produced by knitting or weaving.

In particular hereby, the regions of the textile main body 141 on which the functional elements 146 are intended to be arranged can be in the form of a tuck-stitch knitted fabric.

Figure 4:
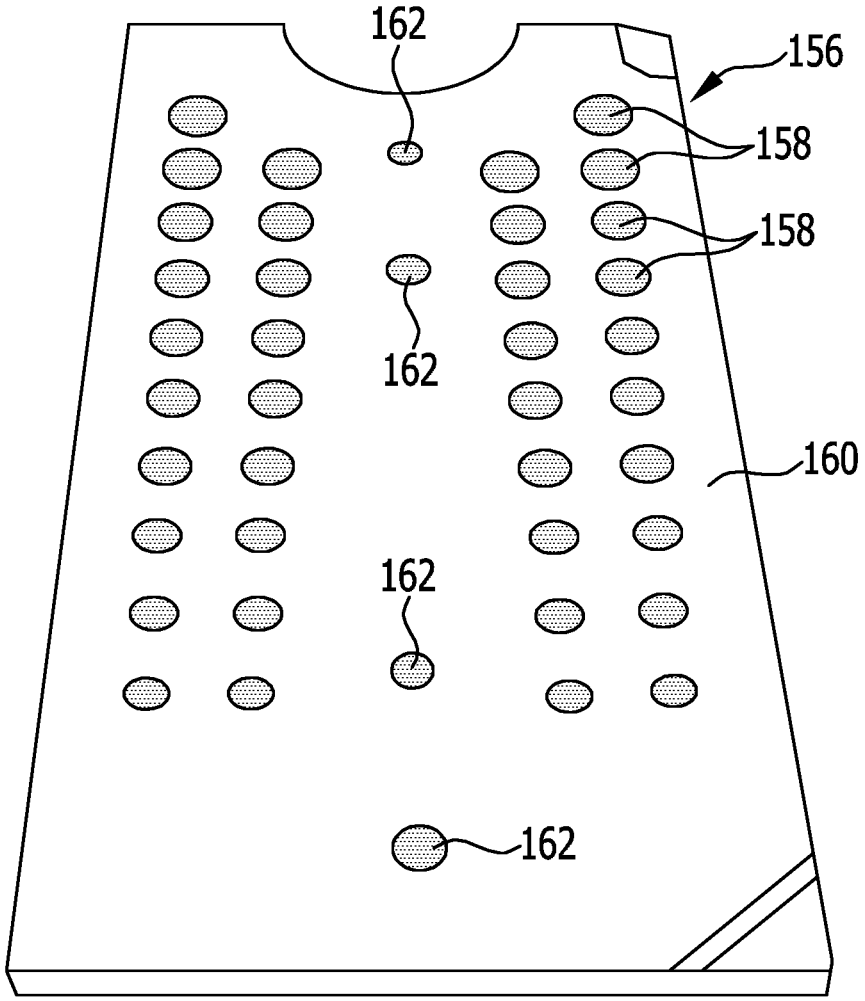
FIG. 4 a perspective illustration of a shaped part with recesses for functional elements for accommodating a functional-element starting material.

For the purposes of producing the functional elements 146, there is provided a shaped part 156 which is schematically illustrated in FIG. 4 and which comprises recesses 158 for the functional elements that are substantially complementary to the functional elements 146 of the stimulus inducing structures 144 and are arranged in a contact surface 160 of the shaped part 156.

The recesses for the functional elements 158 differ from one another in regard to the depth thereof, the cross section thereof at the contact surface 160 and the shape thereof in a manner corresponding to the respectively associated functional element 146.

The contact surface 160 can be substantially flat.

The shaped part 156 can be substantially plate-like.

The shaped part 156 can be formed from a metallic material for example.

The recesses for functional elements 158 can, for example, be produced by a cutting process and in particular, milling, or by etching the shaped part 156.

Apart from the recesses for functional elements 158, the shaped part 156 can comprise further recesses 162 which do not serve for accommodating a functional-element starting material, but rather for example, for positioning the shaped part 156 during its production process or during a step in the method of producing the article of clothing 100.

Figure 5:
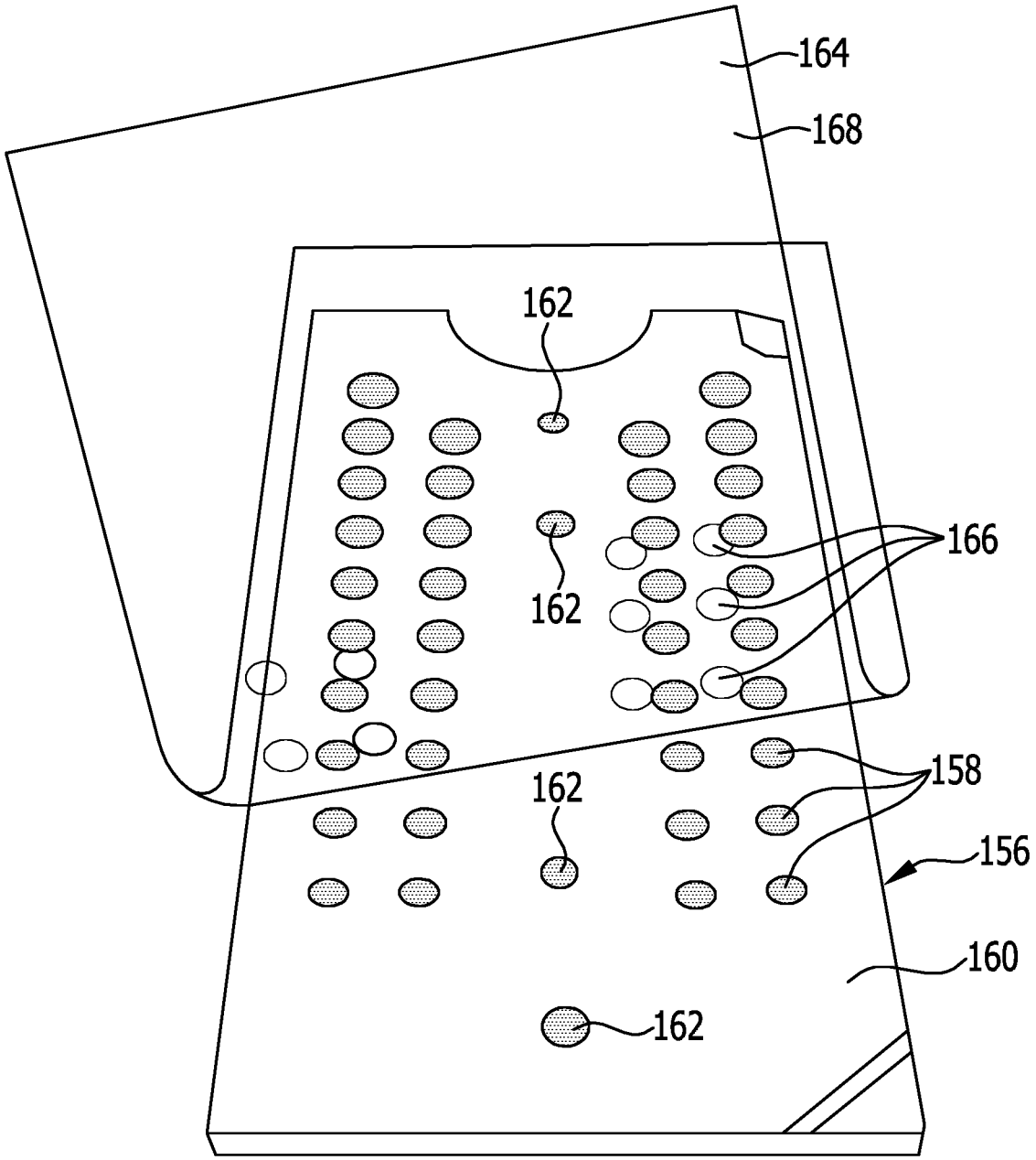
FIG. 5 a perspective illustration which illustrates the placement of an auxiliary filling foil on the shaped part.

As illustrated in FIG. 5, an auxiliary filling element 164 which comprises a respective filling opening 166 associated with each of the recesses for functional elements 158 of the shaped part 156 is arranged on the contact surface 160 of the shaped part 156.

Each filling opening 166 of the auxiliary filling element 164 corresponds in regard to the geometry and the cross section of the geometry and the cross section and in particular diameter thereof with the respectively associated recesses for functional elements 158 in the contact surface 160 of the shaped part 156.

The auxiliary filling element 164 is arranged on the shaped part 156 in such a way that the filling openings 166 of the auxiliary filling element 164 are in alignment with the recesses for functional elements 158 in the shaped part 156.

In particular, the auxiliary filling element 164 is preferably in the form of a flexible planar element such as an auxiliary filling foil 168 for example.

The thickness D of this planar element is preferably at least approximately 0.04 mm and in particular, at least approximately 0.08 mm.

Furthermore, the thickness D of the planar element preferably amounts to at most approximately 0.7 mm and in particular, to at most approximately 0.35 mm.

Figure 6:
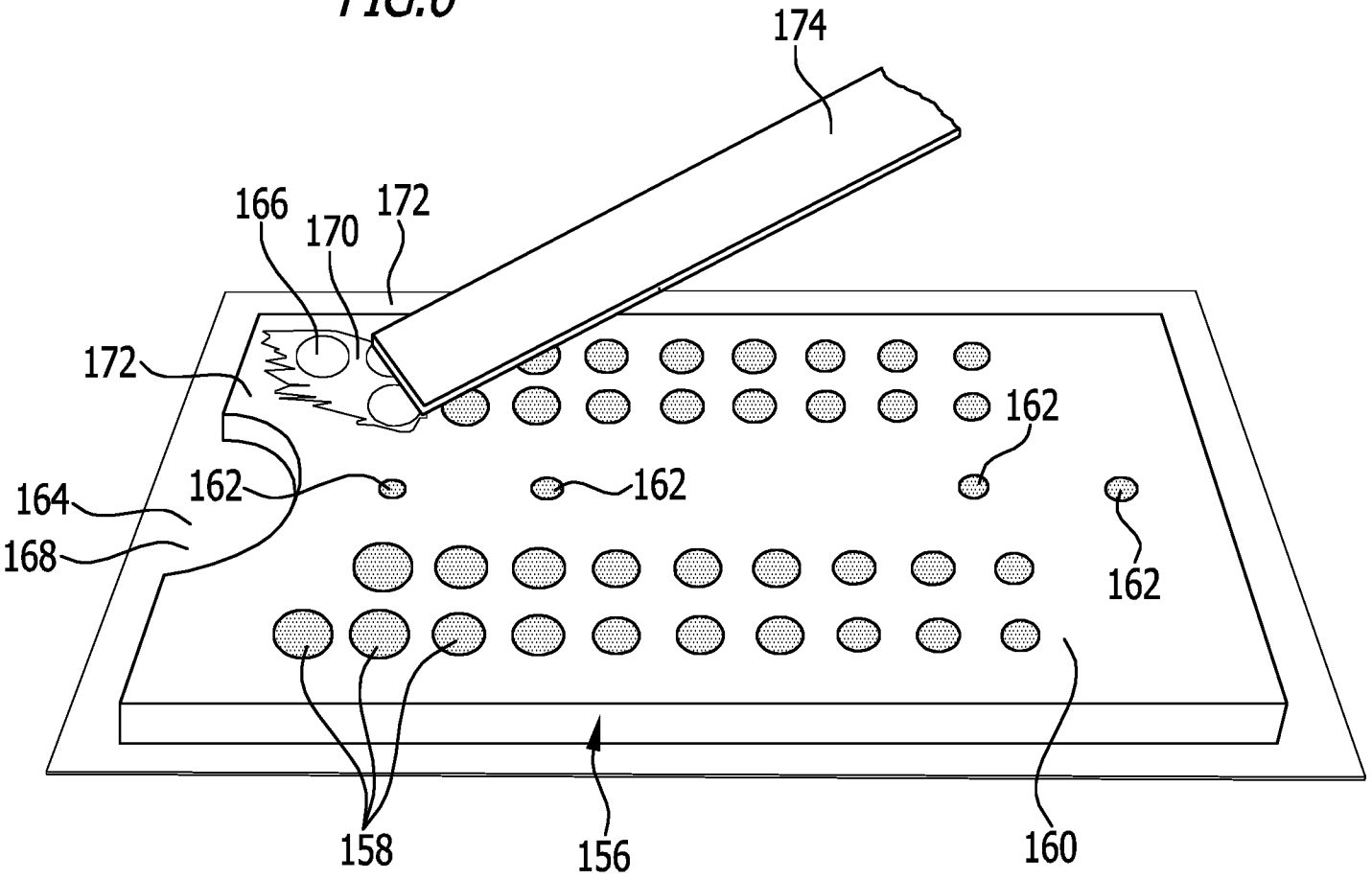
FIG. 6 a perspective illustration which illustrates the process of introducing the functional-element starting material into the recesses for functional elements in the shaped part.
Figure 8:
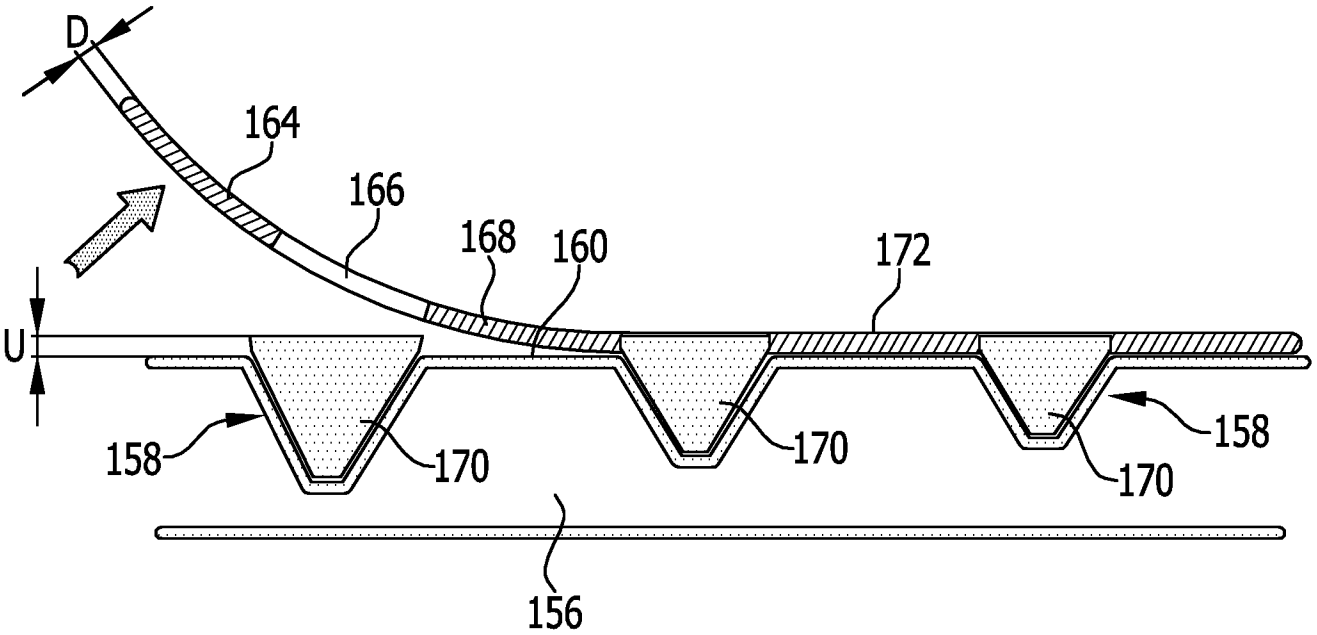
FIG. 8 a schematic longitudinal section through the shaped part, the auxiliary filling foil arranged on the shaped part and the functional-element starting material which has been introduced into the recesses for functional elements of the shaped part and the filling openings in the auxiliary filling foil during the process of lifting-off the auxiliary filling foil.

A functional-element starting material 170 is now introduced through the filling openings 166 of the auxiliary filling element 164 into the recesses for functional elements 158 in the shaped part 156, whereby the filling openings 166 are also filled with the functional-element starting material 170 up to the upper surface 172 of the auxiliary filling element 164 remote from the shaped part 156 (see FIGS. 6 and 8).

For example, the functional-element starting material 170 can be introduced into the recesses for the functional elements 158 and the filling openings 166 by means of a hand-held scraper blade 174.

In order to remove any of the functional-element starting material 170 protruding above the filling openings 166 of the auxiliary filling element 164, the functional-element starting material 170 is scraped off so as to be flush with the upper surface 172 of the auxiliary filling element 164 by means of the hand-held scraper blade 174 for example.

A silicone material can be used as the functional-element starting material 170 for example.

A silicone material which is mixed from the components Elastosil LR 3003/60 A and Elastosil LR 3003/60 B is especially suitable. These two components are sold under the above-mentioned names by Wacker Chemie A G, Johannes Hess Strasse 24, 84489 Burghausen, Germany.

Preferably thereby, equal portions of the components Elastosil LR 3003/60 A and Elastosil LR 3003/60 B are mixed with one another.

In order to produce functional elements 146 having different degrees of Shore A-hardness, different functional-element starting materials 170 can be introduced into the recesses for the functional elements 158.

Figure 7:
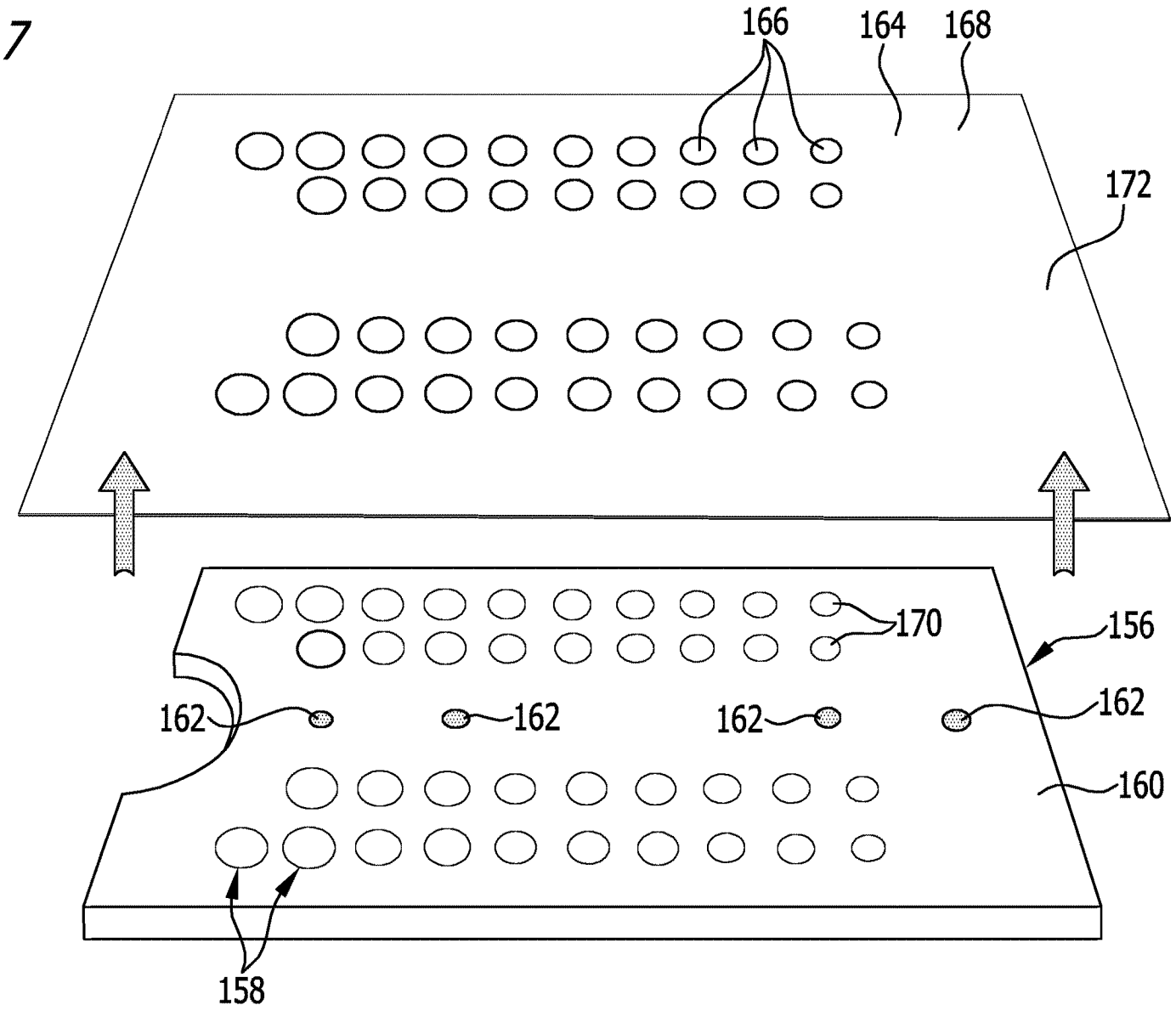
FIG. 7 a perspective illustration which illustrates the removal of the auxiliary filling foil from the shaped part after the introduction of the functional-element starting material into the recesses for functional elements.

After the process of introducing the functional-element starting material 170 into the recesses for functional elements 158 of the shaped part 156, the auxiliary filling element 164 is removed from the shaped part 156 (see FIG. 7), whereby the functional-element starting material 170 then protrudes above the recesses for the functional elements 158 by a projecting amount U.

The projecting amount U corresponds to the thickness D of the auxiliary filling element 164.

Consequently, the projecting amount U preferably amounts to at least approximately 0.04 mm and in particular, to at least approximately 0.08 mm, and preferably to at most approximately 0.7 mm and in particular, to at most approximately 0.35 mm.

This projecting amount U causes an adequate quantity of functional-element starting material 170 to penetrate into the textile main body 141 so as to produce a strong, permanent, substance-to-substance bond with the textile main body 141.

Figure 9:
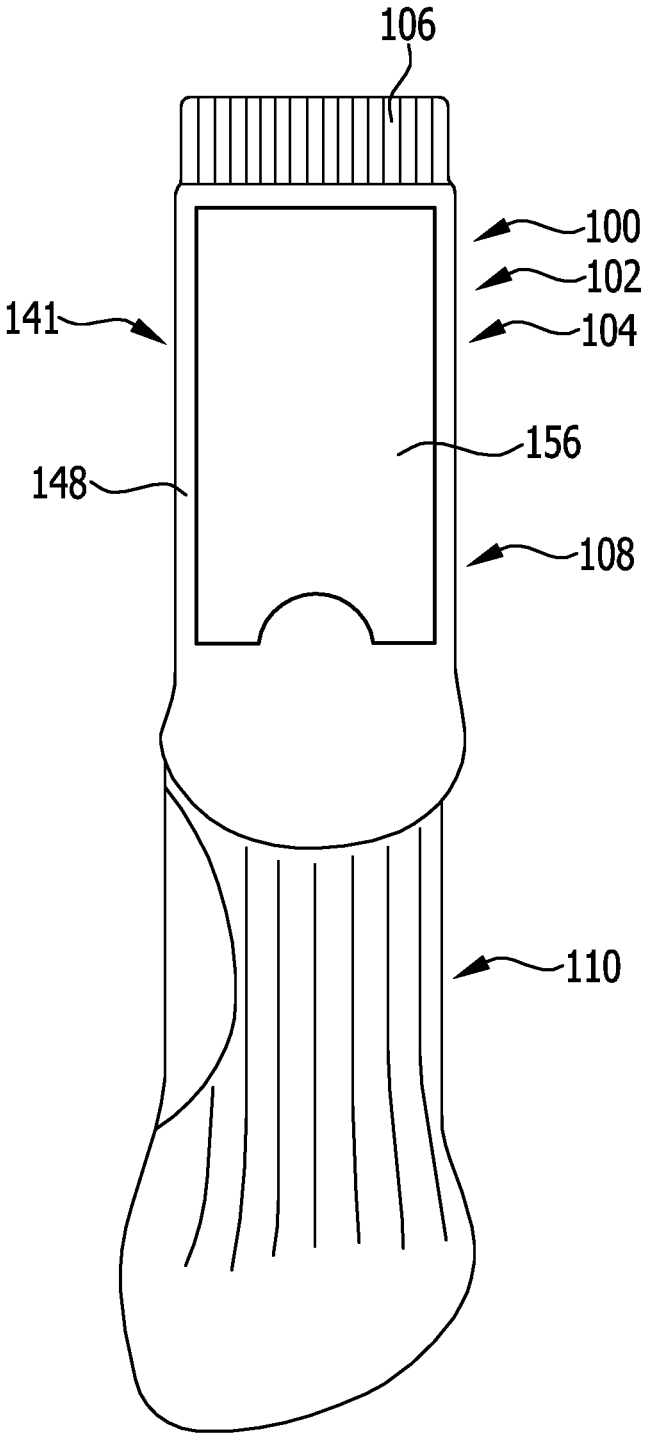
FIG. 9 a schematic diagram which illustrates the process of bringing the shaped part that is provided with the functional-element starting material and the textile main body of the article of clothing into contact.

After removing the auxiliary filling element 164, the shaped part 156 is arranged on the associated region of the textile main body 141, whereby the shaped part 156 rests on the textile main body 141 over the contact surface 160 (see FIG. 9).

Figure 10:
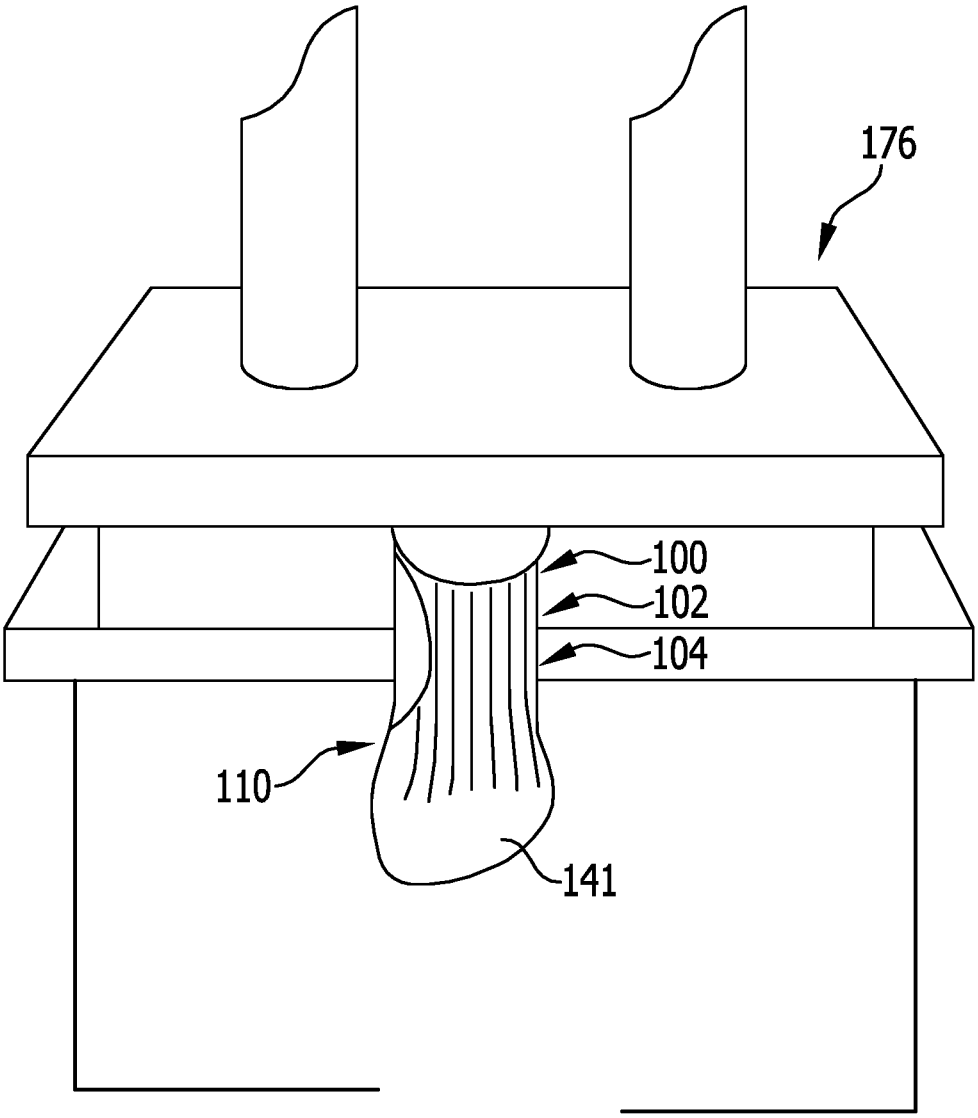
FIG. 10 a schematic diagram which illustrates the production of the functional elements connected to the textile main body by a substance-to-substance bond from the functional-element starting material in a heatable press.

The shaped part 156 and the adjoining region of the textile main body 141 are introduced into a pressing device 176 which may be in the form of a transfer press for example (see FIG. 10).

The shaped part 156 and the textile main body 141 are pressed against each other by means of the pressing device 176 at a pressure of approximately 0.5 bar to approximately 1 bar for example, and preferably of approximately 0.6 bar for a pressing time of approximately 4 minutes to approximately 8 minutes, preferably approximately 6 minutes.

Furthermore, the pressing device 176 is heatable so that the shaped part 156 and the textile main body 141 can be held at a pressing temperature in the region of approximately 140° C. to 200° C. and preferably of approximately 170° C. during the pressing operation.

Due to the application of pressure and the pressing temperature, the functional-element starting material 170 sets and produces a strong and permanent connection to the textile main body 141.

After the pressing operation, the textile main body 141 and the shaped part 156 are cooled down for a cooling time of approximately 10 minutes for example.

Figure 11:
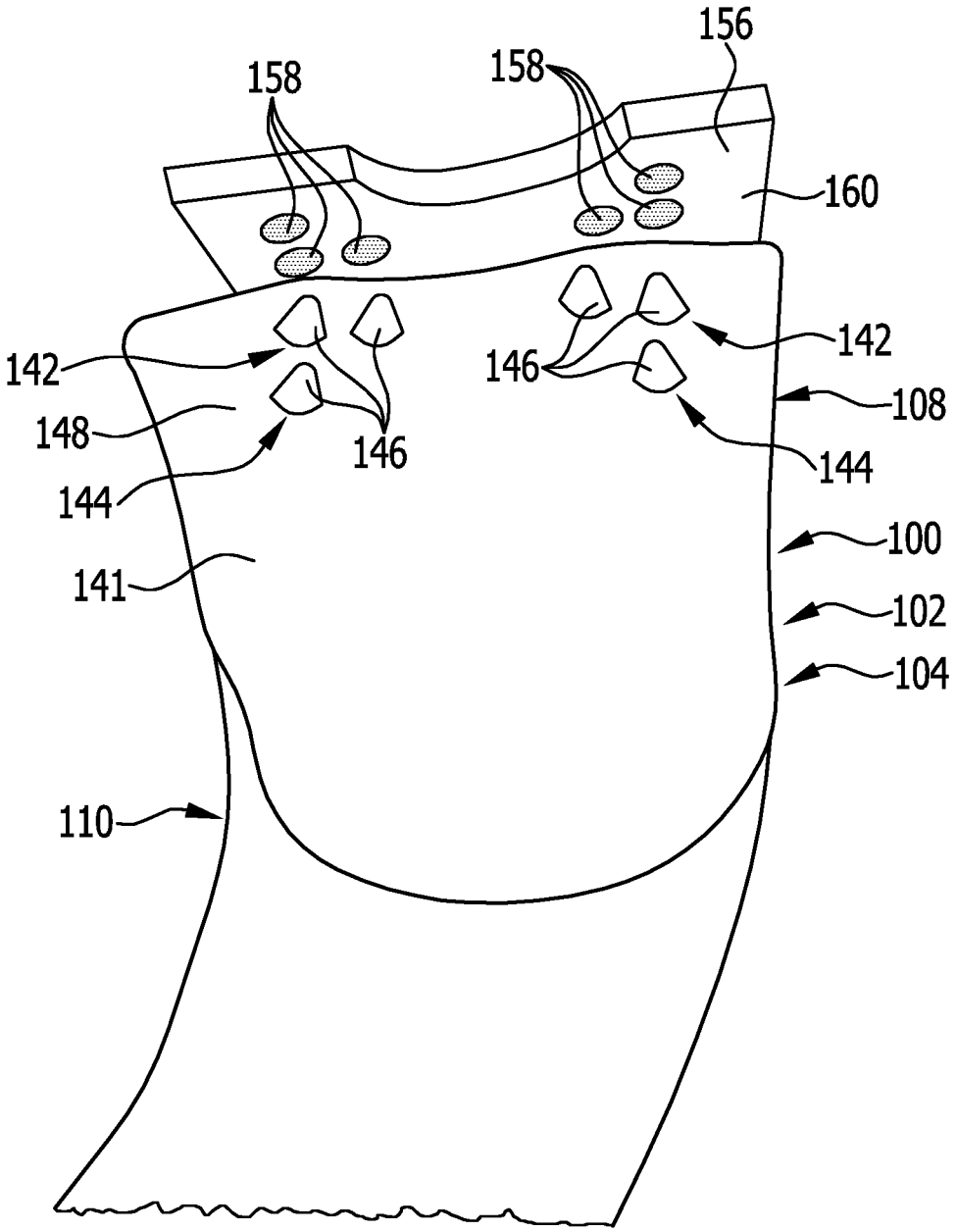
FIG. 11 a schematic perspective diagram which illustrates the detachment of the textile main body with the functional elements produced thereon from the shaped part.

Subsequently, the textile main body 141 together with the functional elements 146 connected thereto by a substance-to-substance bond on the one hand and the shaped part 156 on the other are released from one another (see FIG. 11).

The production of the article of clothing 100 and in particular, an article of clothing in the form of a stocking 104 is thus at an end.

Figure 12:
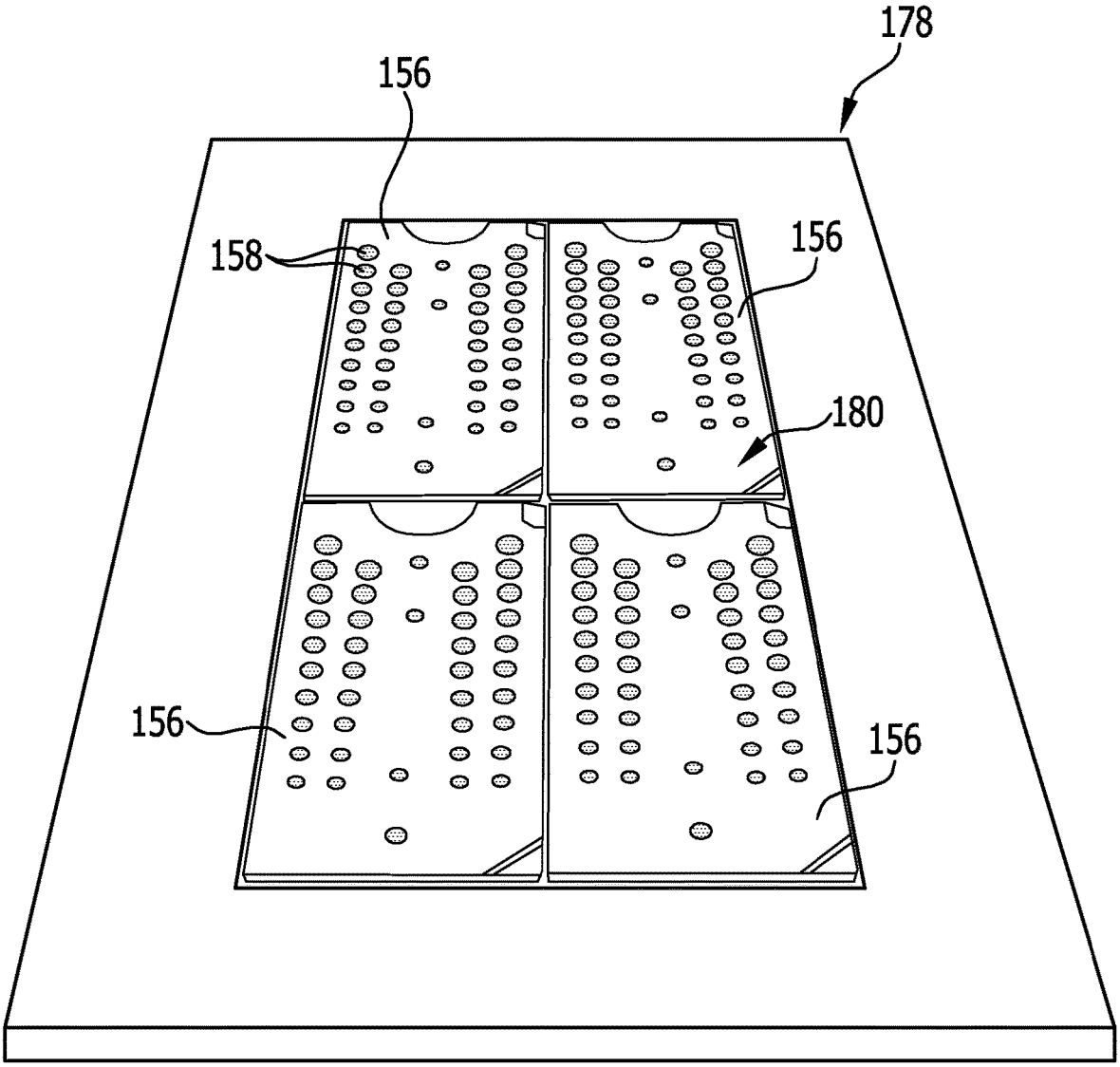
FIG. 12 a schematic illustration of a screen printing machine into which a plurality of shaped parts with recesses for functional elements are placed for the purpose of carrying out a second embodiment of a method for producing an article of clothing.
Figure 13:
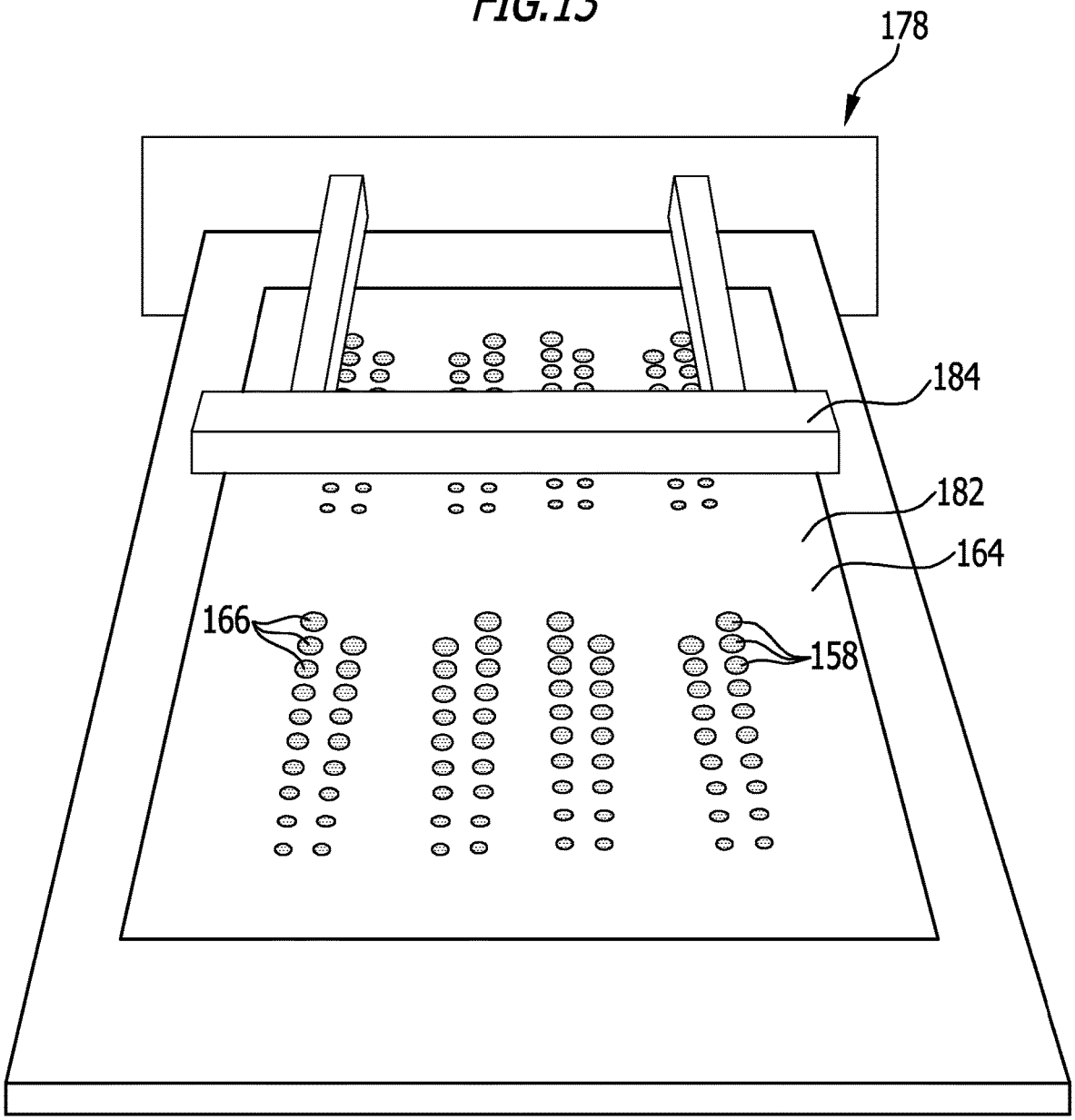
FIG. 13 a schematic perspective illustration of the screen printing machine depicted in FIG. 12 with the shaped parts placed therein and an auxiliary filling screen laid upon the shaped parts whilst the functional-element starting material is introduced through the filling openings of the auxiliary filling screen into the recesses for functional elements in the shaped parts by means of a mechanically operated scraper blade.

A second embodiment of a method for producing an article of clothing 100 comprising a textile main body 141 and functional elements 146 connected to the main body 141 by a substance-to-substance bond which is illustrated in outline in FIGS. 12 and 13 differs from the previously described first embodiment in that the process of introducing the functional-element starting material into the recesses for functional elements 158 in the shaped part 156 is not effected by means of a hand-held scraper blade 174 but rather, mechanically such as in a screen printing machine 178 for example.

For this purpose, one or more shaped parts 156, four shaped parts 156 for example, are inserted into a shaped-part receptacle 180 of a screen printing machine 178 and fixed there (see FIG. 12).

An auxiliary filling element 164 in the form of an auxiliary filling screen 182 is placed on the shaped parts 156.

The auxiliary filling screen 182 covers all of the shaped parts 156 arranged in the shaped-part receptacle 180 and comprises a respectively associated filling opening 166 for each of the recesses for functional elements 158 in the shaped parts 156, the geometry of the opening corresponding to that of the respectively associated recess 158 for the functional element and being congruent therewith (see FIG. 13).

In this embodiment, the process of introducing the functional-element starting material into the recesses for functional elements 158 and into the filling openings 166 is effected by means of a mechanically operated scraper-blade 184 which spreads the functional-element starting material through the filling openings 166 of the auxiliary filling screen 182 into the recesses for functional elements 158 in the shaped parts 156.

After the process of machine-coating the functional-element starting material, the auxiliary filling screen 182 is removed from the shaped parts 156. The shaped parts 156 are freed from the screen printing machine 178 and, as already described, are placed in contact with a respectively associated textile main body 141 and then pressed.

In all other respects, the second embodiment of a method for producing an article of clothing 100 comprising a textile main body 141 with functional elements 146 connected thereto by a substance-to-substance bond which is illustrated in FIGS. 12 and 13 corresponds with the first embodiment illustrated in FIGS. 4 to 11 and so to that extent reference should be made to the preceding description thereof.

What is claimed is:

1. Method for producing an article of clothing which is in the form of an article of leg clothing or an article of upper body clothing and comprises a textile main body and functional elements arranged on the textile main body, comprising the following:

producing the textile main body;

providing a shaped part having at least one recess for a functional element for accommodating a functional-element starting material;

introducing the functional-element starting material into the at least one recess for a functional element;

bringing the shaped part which is provided with the functional-element starting material into contact with the textile main body;

producing at least one functional element which is connected by a substance-to-substance bond to the textile main body from the functional-element starting material;

wherein at least two functional elements are produced which are of mutually differing Shore A-hardness, wherein the at least two functional elements are produced in a compression region of the textile main body of the article of clothing which includes at least one elastic thread and in which, in the worn state of the article of clothing, the textile main body exerts a compressive effect on the body of the wearer of the article of clothing, and wherein the article of clothing comprises a first region which rests on a concavely curved part of the body of the wearer in the worn state of the article of clothing, and a second region which rests on a convexly curved part of the body of the wearer in the worn state of the article of clothing, wherein a first functional element is arranged in the first region of the article of clothing and a second functional element is arranged in the second region of the article of clothing and wherein the Shore A-hardness of the first functional element is higher than the Shore A-hardness of the second functional element.

2. A method in accordance with claim 1, wherein the textile main body is produced by knitting or weaving.

3. A method in accordance with claim 1, wherein at least one functional element comprises an elastomeric material.

4. A method in accordance with claim 1, wherein at least one functional element has a Shore A-hardness of at least 40.

5. A method in accordance with claim 1, wherein at least one functional element has a Shore A-hardness of at most 100.

6. A method in accordance with claim 1, wherein an auxiliary filling element is arranged on the shaped part whilst the functional-element starting material is introduced into the at least one recess for a functional element, wherein the auxiliary filling element is removed from the shaped part before bringing the shaped part into contact with the textile main body.

7. A method in accordance with claim 6, wherein the auxiliary filling element comprises at least one filling opening which is associated with a recess for a functional element of the shaped part that is to be filled with the functional-element starting material.

8. A method in accordance with claim 6, wherein the auxiliary filling element is in the form of a planar element having a thickness of at least 0.04 mm.

9. A method in accordance with claim 6, wherein the auxiliary filling element is in the form of a planar element having a thickness of at most 0.7 mm.

10. Article of clothing in the form of an article of leg clothing or an article of upper body clothing, comprising a textile main body and functional elements arranged on the textile main body, wherein the article of clothing comprises at least two functional elements, which are of mutually differing Shore A-hardness, wherein the at least two functional elements are arranged in a compression region of the textile main body of the article of clothing which includes at least one elastic thread and in which, in the worn state of the article of clothing, the textile main body exerts a compressive effect on the body of the wearer of the article of clothing, and wherein the article of clothing comprises a first region which rests on a concavely curved part of the body of the wearer in the worn state of the article of clothing, and a second region which rests on a convexly curved part of the body of the wearer in the worn state of the article of clothing, wherein a first functional element is arranged in the first region of the article of clothing and a second functional element is arranged in the second region of the article of clothing and wherein the Shore A-hardness of the first functional element is higher than the Shore A-hardness of the second functional element.

11. An article of clothing in accordance with claim 10, wherein the height of the first functional element is greater than the height of the second functional element.

12. An article of clothing in accordance with claim 10, wherein at least one functional element comprises a substantially conical section.

13. An article of clothing in accordance with claim 10, wherein at least one functional element is in the form of a knop.

14. An article of clothing in accordance with claim 10, wherein at least one functional element has a greatest extent along the textile main body of at most 12 mm.

15. An article of clothing in accordance with claim 10, wherein at least one functional element is arranged on an inner surface of the textile main body which faces the body of the wearer in the worn state of the article of clothing.

16. An article of clothing in accordance with claim 10, wherein the at least two functional elements are of mutually differing heights.

17. Method for producing an article of clothing which comprises a textile main body and functional elements arranged on the textile main body, comprising the following:

producing the textile main body;

providing a shaped part having at least one recess for a functional element for accommodating a functional-element starting material;

introducing the functional-element starting material into the at least one recess for a functional element;

bringing the shaped part which is provided with the functional-element starting material into contact with the textile main body;

producing at least one functional element which comprises an elastomeric material and which is connected by a substance-to-substance bond to the textile main body from the functional-element starting material;

wherein an auxiliary filling element is arranged on the shaped part whilst the functional-element starting material is introduced into the at least one recess for a functional element, wherein the auxiliary filling element is removed from the shaped part before bringing the shaped part into contact with the textile main body, wherein the auxiliary filling element comprises at least one filling through opening which extends through the auxiliary filling element up to a surface of the auxiliary filling element facing away from the shaped part when the auxiliary filling element is arranged on the shaped part and is associated with a recess for a functional element of the shaped part that is to be filled with the functional-element starting material, wherein the functional-element starting material is introduced into the respective recess for a functional element through the respective filling through opening and wherein the respective filling through opening is filled with the functional-element starting material up to the surface of the auxiliary filling element facing away from the shaped part, and wherein the auxiliary filling element is a flexible planar element.

18. A method in accordance with claim 17, wherein the auxiliary filling element is in the form of a planar element having a thickness of at least 0.04 mm.

19. A method in accordance with claim 17, wherein the auxiliary filling element is in the form of a planar element having a thickness of at most 0.7 mm.

20. A method in accordance with claim 1, wherein at least two functional elements are produced which are of mutually differing heights.

21. A method in accordance with claim 1, wherein a difference in the degrees of Shore A-hardness of the two functional elements which are of mutually differing Shore A-hardness amounts to at least 20.

22. An article of clothing according to claim 10, wherein a difference in the degrees of Shore A-hardness of the two functional elements which are of mutually differing Shore A-hardness amounts to at least 20.

23. A method in accordance with claim 1, wherein the first region rests on an ankle bone of the body of the wearer in the worn state of the article of clothing and/or the second region rests on a calf musculature of the body of the wearer in the worn state of the article of clothing.

24. An article of clothing in accordance with claim 10, wherein the first region rests on an ankle bone of the body of the wearer in the worn state of the article of clothing and/or the second region rests on a calf musculature of the body of the wearer in the worn state of the article of clothing.

25. A method in accordance with claim 17, wherein at least two functional elements are produced which are of mutually differing Shore A-hardness, wherein the article of clothing comprises a first region which rests on a concavely curved part of the body of the wearer in the worn state of the article of clothing, and a second region which rests on a convexly curved part of the body of the wearer in the worn state of the article of clothing, wherein a first functional element is arranged in the first region of the article of clothing and a second functional element is arranged in the second region of the article of clothing and wherein the Shore A-hardness of the first functional element is higher than the Shore A-hardness of the second functional element.

26. A method in accordance with claim 25, wherein the first region rests on an ankle bone of the body of the wearer in the worn state of the article of clothing and/or the second region rests on a calf musculature of the body of the wearer in the worn state of the article of clothing.

* * * * *